US012617599B2

(12) United States Patent
Huang

(10) Patent No.: US 12,617,599 B2
(45) Date of Patent: May 5, 2026

(54) ADAPTIVE BEVERAGE CONTAINER SLEEVE

(71) Applicant: Guangdong Musen Daily Products Co., Ltd., Yangjiang City (CN)

(72) Inventor: SiHua Huang, Yangjiang City (CN)

( * ) Notice: Subject to any disclaimer, the term of this patent is extended or adjusted under 35 U.S.C. 154(b) by 0 days.

(21) Appl. No.: 18/811,646

(22) Filed: Aug. 21, 2024

(65) Prior Publication Data

US 2025/0320051 A1 Oct. 16, 2025

(30) Foreign Application Priority Data

Apr. 12, 2024 (CN) ..... 202410443343.9

(51) Int. Cl.
*B65D 81/38* (2006.01)
*B65D 21/08* (2006.01)

(52) U.S. Cl.
CPC ..... *B65D 81/3881* (2013.01); *B65D 21/08* (2013.01)

(58) Field of Classification Search
CPC ..... B65D 81/3865; B65D 81/3867; B65D 81/3869; B65D 81/3872; B65D 81/3874; B65D 81/3876; B65D 81/3879; B65D 81/3881; B65D 81/3883; B65D 81/3886; B65D 81/3888; B65D 81/389; B65D 81/3893; B65D 81/3895; B65D 81/3897
See application file for complete search history.

(56) References Cited

U.S. PATENT DOCUMENTS

| | | | | |
|---|---|---|---|---|
| 3,717,282 | A * | 2/1973 | Nordskog | A47F 1/06 206/817 |
| 4,910,977 | A * | 3/1990 | Hilton | A45C 11/20 D7/608 |
| 10,457,471 | B2 * | 10/2019 | Jacob | B65D 47/06 |
| 10,773,873 | B2 * | 9/2020 | Callinan | B65D 81/3881 |
| 2019/0337705 | A1 * | 11/2019 | McGee | B65D 83/766 |
| 2023/0174292 | A1 * | 6/2023 | Tollefspol | B65D 81/3881 220/739 |

* cited by examiner

*Primary Examiner* — Javier A Pagan
(74) *Attorney, Agent, or Firm* — Shen Huang

(57) ABSTRACT

The disclosure provides an adaptive beverage container sleeve kit, comprising a sleeve for sleeving a beverage container, a positioning structure, detachably connected to a top of the sleeve and configured to bond the beverage container with different widths, wherein the positioning structure is capable of contacting at least a part of the beverage container such that when the beverage container sleeve kit is inverted. When the positioning structure is connected to the sleeve and contacts the beverage container, the user is capable of drinking a beverage from the beverage container. An adjusting structure is located in the placement cavity and arranged along the bottom end of the inner shell and has a bonding portion connected with the bottom end of the inner shell and a contact portion contacting a bottom end of the beverage container and is deformed.

14 Claims, 7 Drawing Sheets

ADAPTIVE BEVERAGE CONTAINER SLEEVE

FIELD OF TECHNOLOGY

The disclosure relates to the field of daily necessities, and in particular to an adaptive beverage container sleeve kit.

BACKGROUND

In daily life, people often need to come into contact with various beverages such as alcohol, water, juice, coffee, etc. After freezing, the outer walls of beverage containers such as bottles and cans that hold the drinks are cold and prone to water droplets. Directly touching them with hands can cause discomfort due to being too cold, and can also wet hands. After heating the drinks, the outer walls of beverage containers such as bottles and cans that hold the drinks are relatively hot, which can easily burn hands. The beverage container kit is used to be placed outside the beverage container, providing insulation and warmth, ensuring the taste of cold or hot drinks without causing cold, wet or hot hands, and improving grip comfort.

The existing beverage container kit, such as a utility model patent titled "Insulated Container and Combination Beverage Container" (Announcement No.: CN219289184U) authorized for publication on Jul. 4, 2023, includes an insulation kit and a positioning piece that can be detachably connected to the insulation kit. The shell of the insulation kit is equipped with a vacuum zone, which can provide insulation to the beverage container placed inside the insulation kit, thereby locking or maintaining the temperature of the beverage for a certain period of time to ensure the taste of the food and meet the needs of different temperature scenarios. The positioning piece is used as a lid and can adapt to various width and size beverage container kits. However, the beverage container kit of this technical solution cannot provide support for the bottom of beverage containers of different heights and sizes, which is not conducive to stable fitting of beverage containers of different heights and sizes.

SUMMARY

In view of the defects in the prior art, the disclosure provides an adaptive beverage container sleeve kit, which can support a bottom end of a beverage container and adaptively support the bottom end of the beverage container with different heights, thereby improving the stability of sleeving the beverage container with different heights and making the adaptive beverage container sleeve kit have wide applicability.

An adaptive beverage container sleeve kit provided by the disclosure, comprising: a sleeve for sleeving a beverage container, comprising an outer shell, an inner shell and a sealed vacuum cavity, wherein the inner shell has a first inner wall and a first outer wall, the first inner wall of the inner shell forming a placement cavity for accommodating the beverage container, and the sealed vacuum cavity being located between the outer shell and the inner shell such that the sleeve functions to maintain a temperature; the inner shell has a top and a bottom end, the top being provided with a through hole through which the beverage container is put in or taken out; a positioning structure, detachably connected to a top of the sleeve and configured to bond the beverage container with different widths, wherein the positioning structure is capable of contacting at least a part of the beverage container such that when the beverage container sleeve kit is inverted, the beverage container does not fall out of the beverage container sleeve kit; besides, when the positioning structure is connected to the sleeve and contacts the beverage container, the user is capable of drinking a beverage from the beverage container; and an adjusting structure, located in the placement cavity, wherein the adjusting structure is arranged along the bottom end of the inner shell and has a bonding portion connected with the bottom end of the inner shell and a contact portion contacting a bottom end of the beverage container, a height between the bonding portion and the contact portion is deformable to adapt to placement of the beverage container with different heights, and the adjusting structure is deformed to adjust a height along a direction from a bottom end toward a top of the placement cavity, a height of the deformation being less than an overall height of the inner shell, and a width of the deformation being less than a width of the inner shell.

According to the beverage container sleeve kit provided by the disclosure, According to the beverage container sleeve kit provided by this example, the adjusting structure is arranged in the, the adjusting structure has the bonding portion connected with the bottom end of the inner shell and the contact portion contacting the bottom end of the beverage container. The height between the bonding portion and the contact portion is deformable to adapt to placement of the beverage container with different heights. In this way, by making the contact portion contact the bottom end of the beverage container, the adjusting structure can support the bottom end of the beverage container; and by deforming the height between the bonding portion and the contact portion, the bottom end of the beverage container with different heights can be adaptively supported, thereby improving the stability of sleeving the beverage container with different heights and making the beverage container sleeve kit have wide applicability. Moreover, the positioning structure is capable of contacting at least a part of the beverage container such that when the beverage container sleeve kit is inverted, the beverage container does not fall out of the beverage container sleeve kit. That is, after the user puts the beverage container into the placement cavity formed by the first inner wall via the through hole at the top of the inner shell and detachably connects the positioning structure to the top of the sleeve, all or part of the beverage container is capable of being limited between the adjusting structure and the positioning structure. When the beverage container sleeve kit is placed upright, the bottom end of the beverage container can be supported by means of the adjusting structure, which improves the stability of sleeving the beverage container with different heights. When the beverage container sleeve kit is inverted, the beverage container can be supported by means of the positioning structure, so that even when the beverage container is sleeved in the beverage container sleeve kit, the user can drink or pour the beverage in the beverage container normally. Thus, the beverage container sleeve kit is convenient to use.

BRIEF DESCRIPTION OF THE DRAWINGS

The accompanying drawings described herein are intended to provide further understanding of the present invention and form a part of the present application. The illustrative embodiments of the present invention and their description are used to explain the present invention and do not constitute undue limitation of the present invention. In the attached figure.

DESCRIPTION OF THE EMBODIMENTS

Figure 1:
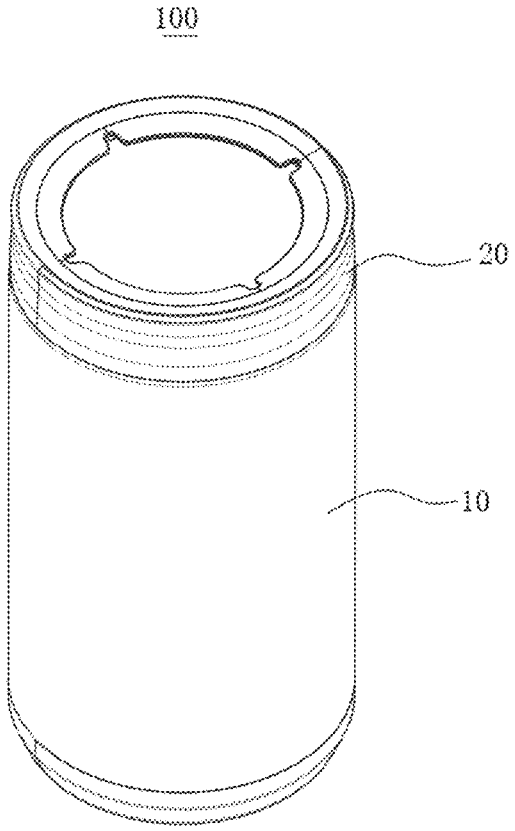
FIG. 1 is a schematic structural view of a beverage container sleeve kit according to an example of the disclosure.

In order to clarify the purpose, technical solution, and advantages of the embodiments of the present invention, the following will provide a clear and complete description of the technical solution of the embodiments of the present invention in conjunction with the accompanying drawings. Obviously, the described embodiments are a part of the embodiments of the present invention, not all embodiments. Based on the described embodiments of the present invention, all other embodiments obtained by ordinary skilled persons in the art without the need for creative labor are within the scope of protection of the present invention.

As shown in FIG. 1 to FIG. 12, an example of the disclosure provides an adaptive beverage container sleeve kit 100, including a sleeve 10, a positioning structure 20 and an adjusting structure 30. The sleeve 10 is used for sleeving a beverage container 200, and includes an outer shell 11, an inner shell 12 and a sealed vacuum cavity 13. The inner shell 12 has a first inner wall 121 and a first outer wall 122. The first inner wall 121 of the inner shell 12 forms a placement cavity 14 for accommodating the beverage container 200, so that the beverage container 200 can be used by holding the outer shell 11 instead of directly holding the beverage container 200, which prevents the hand from getting cold, wet or hot, thereby making the beverage container sleeve kit more comfortable to hold. The sealed vacuum cavity 13 is located between the outer shell 11 and the inner shell 12 such that the sleeve 10 functions to maintain a temperature so as to keep the beverage container 200 in the placement cavity 14 hot or cold, thereby ensuring the taste of the cold or hot beverage in the beverage container 200. The inner shell 12 has a top 123 and a bottom end 124. The top 123 is provided with a through hole 1231 through which the beverage container 200 is put in or taken out. The positioning structure 20 is detachably connected to a top of the sleeve 10 and configured to bond the beverage container 200 with different widths, so as to adapt to the beverage container 200 with different widths in the market, thus making the adaptive beverage container sleeve kit have wide applicability. The positioning structure 20 is capable of contacting at least a part of the beverage container 200 such that when the beverage container sleeve kit 100 is inverted, the beverage container 200 does not fall out of the beverage container sleeve kit 100. Besides, when the positioning structure 20 is connected to the sleeve 10 and contacts the beverage container 200, the user is capable of drinking a beverage from the beverage container 200. The adjusting structure 30 is located in the placement cavity 14. The adjusting structure 30 is arranged along the bottom end of the inner shell 12 and has a bonding portion 31 connected with the bottom end 124 of the inner shell 12 and a contact portion 32 contacting a bottom end of the beverage container 200. A height between the bonding portion 31 and the contact portion 32 is deformable to adapt to placement of the beverage container 200 with different heights, and the adjusting structure 300 is deformed to adjust a height along a direction from a bottom end toward a top of the placement cavity 14. A height of the deformation is less than an overall height of the inner shell 12, and a width of the deformation is less than a width of the inner shell 12. According to the beverage container sleeve kit 100 provided by this example, the adjusting structure 30 is arranged in the 14, the adjusting structure 30 has the bonding portion 31 connected with the bottom end 124 of the inner shell 12 and the contact portion 32 contacting the bottom end of the beverage container 200. The height between the bonding portion 31 and the contact portion 32 is deformable to adapt to placement of the beverage container 200 with different heights. In this way, by making the contact portion 32 contact the bottom end of the beverage container 200, the adjusting structure 30 can support the bottom end of the beverage container 200; and by deforming the height between the bonding portion 31 and the contact portion 32, the bottom end of the beverage container 200 with different heights can be adaptively supported, thereby improving the stability of sleeving the beverage container 200 with different heights and making the beverage container sleeve kit have wide applicability. Moreover, the positioning structure 20 is capable of contacting at least a part of the beverage container 200 such that when the beverage container sleeve kit 100 is inverted, the beverage container 200 does not fall out of the beverage container sleeve kit 100. That is, after the user puts the beverage container 200 into the placement cavity 14 formed by the first inner wall 121 via the through hole 1231 at the top 123 of the inner shell and detachably connects the positioning structure 20 to the top of the sleeve 10, all or part of the beverage container 200 is capable of being limited between the adjusting structure 30 and the positioning structure 20. When the beverage container sleeve kit 100 is placed upright, the bottom end of the beverage container 200 can be supported by means of the adjusting structure 30, which improves the stability of sleeving the beverage container 200 with different heights. When the beverage container sleeve kit 100 is inverted, the beverage container 200 can be supported by means of the positioning structure 20, so that even when the beverage container 200 is sleeved in the beverage container sleeve kit 100, the user can drink or pour the beverage in the beverage container 200 normally. Thus, the beverage container sleeve kit is convenient to use.

Figure 2:
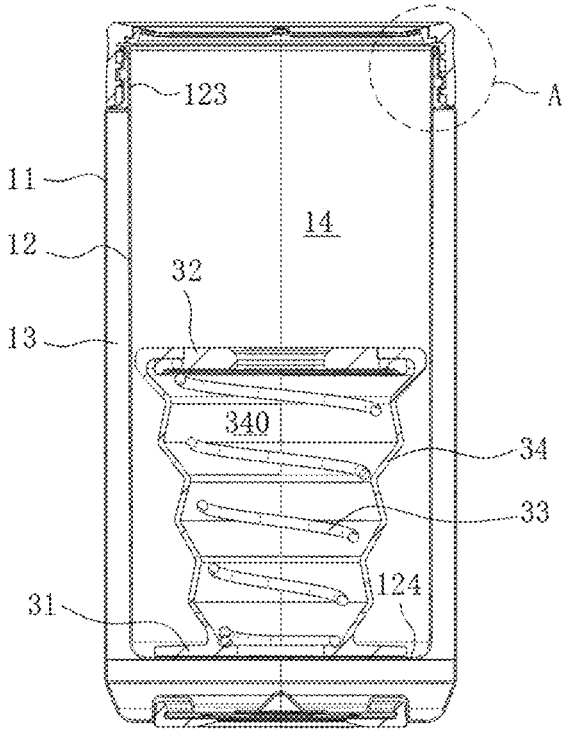
FIG. 2 is a schematic structural sectional view of the beverage container sleeve kit according to an example of the disclosure.
Figure 3:
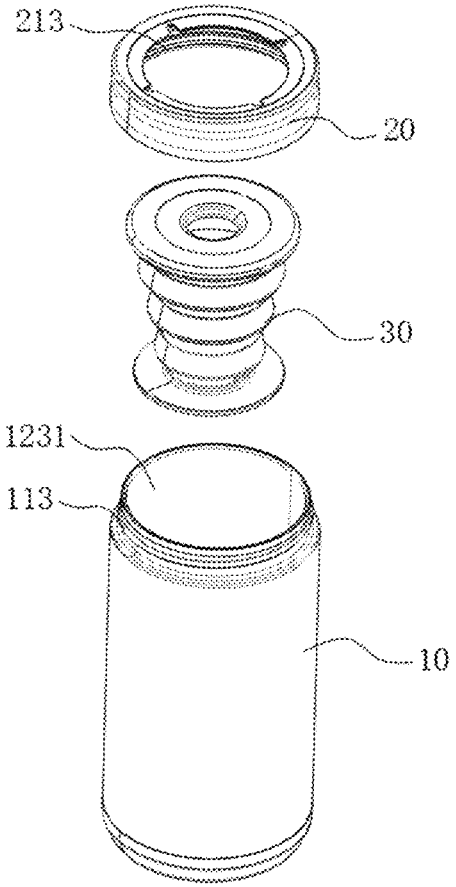
FIG. 3 is a schematic structural exploded view of the beverage container sleeve kit according to an example of the disclosure.

As shown in FIG. 2, in some specific examples, the adjusting structure 30 includes an elastic member 33 arranged along the direction from the bottom end toward the top of the placement cavity 14. The elastic member 33, when subjected to a pressure exerted by the beverage container 200 toward the bottom end of the placement cavity 14, is capable of providing an elastic force for pushing the beverage container 200 to move toward the top of the placement cavity 14 such that at least a part of the beverage container 200 keeps in contact with the positioning structure 20. Thereby, all or part of the beverage container 200 is clamped between the contact portion 32 of the adjusting structure 30 and the positioning structure 20, so that the beverage container 200 is stably sleeved in the beverage container sleeve kit 100. Moreover, while the beverage container sleeve kit 100 is gradually inverted from the upright position, the beverage container 200 cannot easily shake relative to the beverage container sleeve kit 100 in the height direction of the placement cavity 14, so that when the beverage container 200 is sleeved in the beverage container sleeve kit 100, the user can drink or pour the beverage in the beverage container 200 stably and smoothly.

Figure 5:
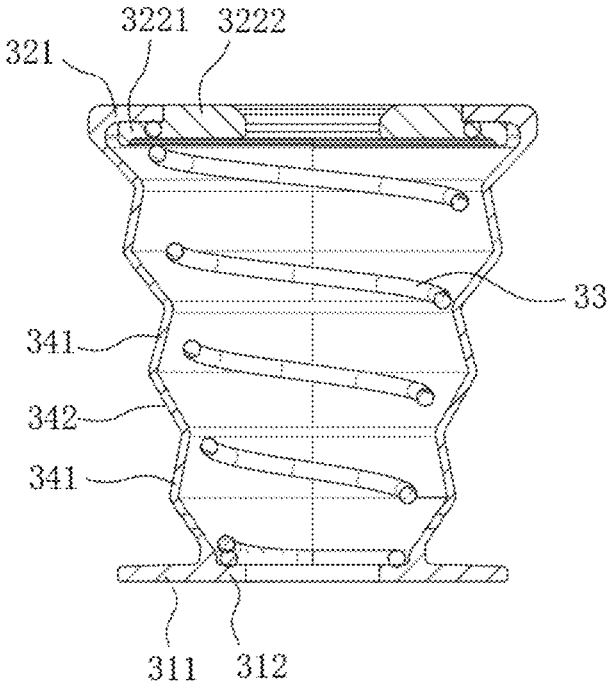
FIG. 5 is a schematic structural sectional view of the adjusting structure according to an example of the disclosure.
Figure 6:
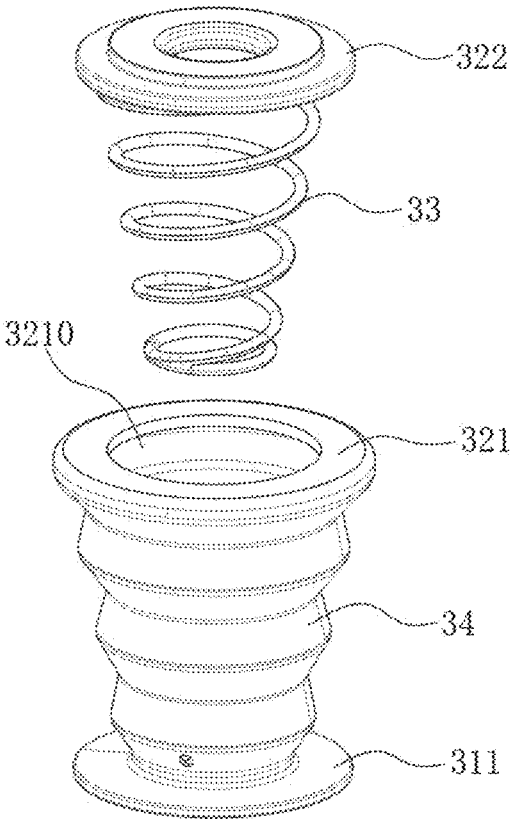
FIG. 6 is a schematic structural exploded view of the adjusting structure according to an example of the disclosure.

As shown in FIG. 5 and FIG. 6, in some specific examples, the elastic member 33 is provided as a spring structure. Optionally, a radius of the spring structure gradually increases from the bottom end of the placement cavity 14 toward the top of the placement cavity 14. This spring structure has a lower tendency to bend, and thus has higher stability for supporting the beverage container 200. In addition, a width of the top of the spring structure is basically the same as the width of the placement cavity 14, and there is a gap between the top of the spring structure and the first inner wall 121, so that while the beverage container 200 is stably supported, the top of the spring structure can move relative to the first inner wall 121 in the height direction of the placement cavity 14. In other examples, the elastic member 33 may also be provided as another structure capable of providing the elastic force, such as elastic silicone or an airbag.

In some specific examples, the adjusting structure 30 further includes a cylindrical member 34 arranged along the direction from the bottom end toward the top of the placement cavity 14. The bonding portion 31 is connected to a bottom end of the cylindrical member 34, and the contact portion 32 is connected to a top end of the cylindrical member 34. An elastic cavity 340 for accommodating the elastic member 33 is arranged inside the cylindrical member 34. The cylindrical member 34 is deformable in height. When the beverage container 200 is placed in the placement cavity 14, the cylindrical member 34 and the elastic member 33 are deformed and shortened in height under the pressure of the beverage container 200, and under the action of the elastic force of the elastic member 33, the height of the cylindrical member 34 is kept at a position capable of clamping all or part of the beverage container 200 between the positioning structure 20 and the contact portion 32. In this example, the beverage container 200 is supported by the elastic member 33 and the cylindrical member 34 at the same time, so that the beverage container 200 can be supported more stably. Moreover, the cylindrical member 34 is arranged around the outside of the elastic member 33, which can protect the elastic member 33 and prolong the service life of the elastic member 33. In other examples, it is also possible to provide the elastic member 33 only and connect the bonding portion 31 and the contact portion 32 respectively to the elastic member 33. In this way, the bottom end of the beverage container 200 can also be supported, and the bottom end of the beverage container 200 with different heights can also be adaptively supported by means of the deformation of the elastic member 33.

As shown in FIG. 5, in some specific examples, a radius of the bottom end of the cylindrical member 34 is less than a radius of the top end, and the cylindrical member 34 is configured to have a shape adapted to that of the elastic member 33 so as to be matched with the elastic member 33.

In some specific examples, the cylindrical member 34 is deformable synchronously with the elastic member 33 so as to stably support the bottom end of the beverage container 200 in cooperation with the elastic member 33. The cylindrical member 34 is provided as a deformable corrugated tube structure made of a rigid material, such as hard rubber or silicone, or the cylindrical member 34 is made of a flexible deformable material, such as soft rubber or silicone. In both cases, the cylindrical member can be deformed along the direction from the bottom end toward the top of the placement cavity 14, i.e., the height direction.

Figure 4:
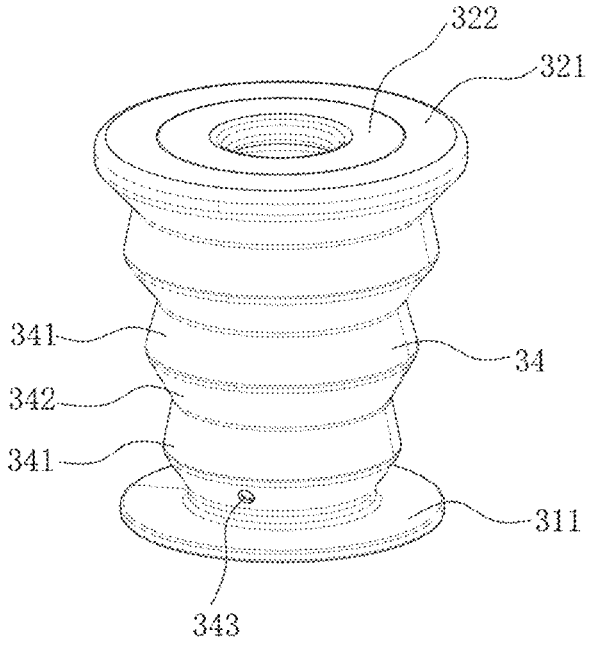
FIG. 4 is a schematic structural view of an adjusting structure according to an example of the disclosure.

As shown in FIG. 4 and FIG. 5, in some specific examples, the cylindrical member 34 includes a plurality of first conical ring pieces 341 and second conical ring pieces 342 arranged alternately. The first conical ring pieces 341 are each arranged at an acute angle relative to a bottom surface of the inner shell 12, and the second conical ring pieces 342 are each arranged at an obtuse angle relative to the bottom surface of the inner shell 12. The second conical ring piece 342 has a bottom end connected to a top end of one first conical ring piece 341 and a top end connected to a bottom end of another first conical ring piece 341. When the cylindrical member 34 is deformed and shortened, an inner surface of the second conical ring piece 342 and an inner surface of the one first conical ring piece 341 become close to each other, and an outer surface of the second conical ring piece 342 and an outer surface of the another first conical ring piece 341 become close to each other.

As shown in FIGS. 2 and 5, in specific examples, the bonding portion 31 includes a first annular piece 311 formed by extending outward from a bottom end of the elastic member 33 along a circumferential direction and a first limiting piece 312 formed by extending inward from the bottom end of the elastic member 33 along the circumferential direction. The bottom end of the elastic member 33 is capable of being limited at a top surface of the first limiting piece 312. The bonding portion 31 may be connected to the bottom end 124 of the inner shell by being directly placed at the bottom wall in the inner shell 12, or connected to the bottom end 124 of the inner shell by being fixed to the bottom wall in the inner shell 12 by means of adhesion, welding or the like. The first annular piece 311 arranged increases the contact area between the bonding portion 31 and the bottom wall in the inner shell 12, thereby improving the stability of the adjusting structure 30 connected to the bottom end 124 of the inner shell.

As shown in FIG. 5 and FIG. 6, in some specific examples, the contact portion 32 includes a second annular piece 321 formed by extending inward from a top end of the elastic member 33 along a circumferential direction and a second limiting piece 322 detachably connected in the second annular piece 321. A middle of the second annular piece 321 forms a mounting hole 3210 through which the elastic member 33 is put in or taken out, which facilitates the assembly of the elastic member 33. The top end of the elastic member 33 is capable of being limited at a bottom surface of the second limiting piece 322, so that the elastic member 33 can be clamped between the first limiting piece 312 and the second limiting piece 322. In other examples, the top end of the elastic member 33 may also be limited at a bottom surface of the second annular piece 321 or at the bottom surfaces of both the second limiting piece 322 and the second annular piece 321 so as to keep the elastic member 33 in the cylindrical member 34.

As shown in FIG. 5, in some specific examples, the second limiting piece 322 includes a main body portion 3221 and a boss portion 3222 formed by protruding outward from a middle of a top of the main body portion 3221, and when the second limiting piece 322 is connected to the second annular piece 321, a top surface on an outer periphery of the main body portion 3221 is limited at the bottom surface of the second annular piece 321, the boss portion 3222 is limited in the mounting hole 3210, and the bottom end of the beverage container 200 is capable of contacting a top surface of the second annular piece 321 and a top surface of the boss portion 3222. In this example, the bonding portion 31, the second annular piece 321 and the cylindrical member 34 are integrally formed and made of a flexible material, and the second annular piece 321 is deformable such that the second limiting piece 322 can enter the elastic cavity 340 via the mounting hole 3210 and be detachably connected to the second annular piece 321. In other examples, the bottom end of the beverage container 200 may also only contact either the second annular piece 321 or the boss portion 3222.

As shown in FIG. 4, in some specific examples, the cylindrical member 34 is provided with two airflow holes 343 communicating the elastic cavity 340 with the placement cavity 14. The airflow holes 343 are used for discharging air in the elastic cavity 340 into the placement cavity 14 when the cylindrical member 34 and the elastic member 33 are compressed by the beverage container 200 to become deformed and shortened, so that the cylindrical member 34 can be compressed by the beverage container 200 to become deformed and shortened. The two airflow holes 343 are arranged at two opposite sides of the cylindrical member 34. In other examples, there may be only one or another number of airflow holes 343. The first limiting piece 312 and the second limiting piece 322 are provided as annular structures, so that through holes communicated with the elastic cavity 340 are formed in the middle of the first limiting piece 312 and the second limiting piece 322, and in this way, the sealed vacuum cavity 13 can keep the bottom end of the beverage container 200 hot or cold.

Figure 7:
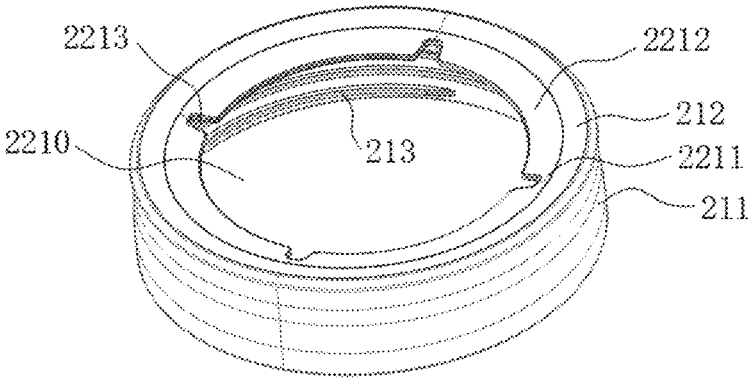
FIG. 7 is a schematic structural view of a positioning structure according to an example of the disclosure.
Figure 8:
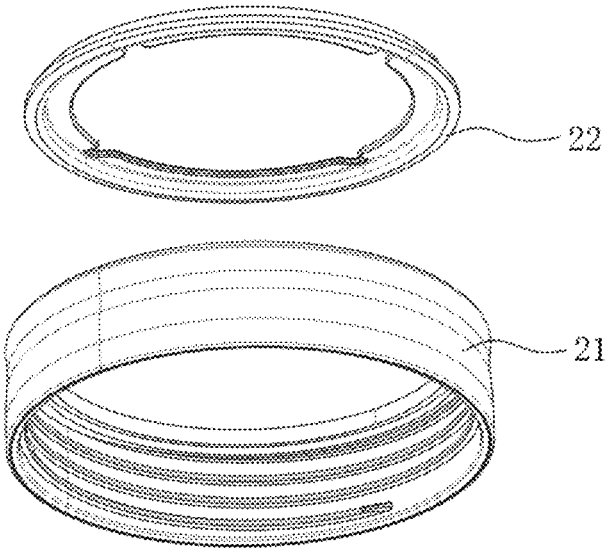
FIG. 8 is a schematic structural exploded view of the positioning structure according to an example of the disclosure.

As shown in FIG. 7 and FIG. 8, in some specific examples, the positioning structure 20 includes an annular connecting member 21 to be detachably connected to the top of the sleeve 10 and an annular positioning member 22 connected along an inner peripheral edge of a top of the annular connecting member 21. The annular positioning member 22 is made of a flexible material, such as soft rubber or silicone. When a width of the beverage container 200 in the placement cavity 14 is greater than a width of an inner periphery of the annular positioning member 22, a force acting on the beverage container 200 drives the annular positioning member 22 to be deformed to a width required for the placement of the beverage container 200, and all or part of the beverage container 200 is clamped between the annular positioning member 22 and the contact portion 32 by means of a combination of the annular positioning member 22 and the beverage container 200. In this way, the adaptive beverage container sleeve kit is suitable for sleeving the beverage container 200 with different widths and heights, thus having wide applicability.

Figure 9:
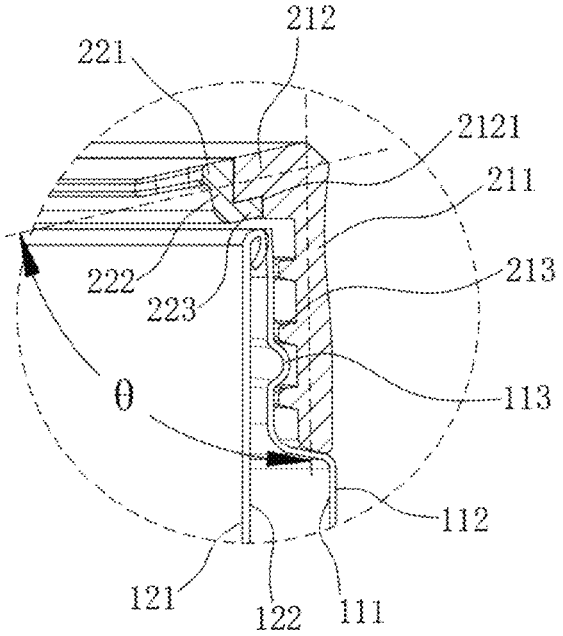
FIG. 9 is a structural enlarged view of A in FIG. 2.

As shown in FIG. 9, in some specific examples, the annular connecting member 21 includes a side plate 211 arranged along a height direction and a top plate 212 formed by extending from an inner peripheral edge of a top of the side plate 211 toward an inside of the placement cavity 14. An inner wall of the side plate 211 is provided with a first threaded structure 213. The outer shell 11 has a second inner wall 111 and a second outer wall 112. A top of the second outer wall 112 is provided with a second threaded structure 113. The positioning structure 20 and the sleeve 10 are detachably connected by means of a threaded fit between the first threaded structure 213 and the second threaded structure 113.

As shown in FIG. 9 in some specific examples, an included angle θ between the top plate 212 and the side plate 211 in a sectional view is less than 90°, so that the top plate 212 can support the beverage container 200 more powerfully. A bottom surface of the top plate 212 is depressed along an inner peripheral edge of the top plate 212 to form a bonding groove 2121. The annular positioning member 22 is arranged along a direction from the top plate 212 toward the inside of the placement cavity 14, and includes a positioning portion 221 for contacting the beverage container 200, a first bonding portion 222 extending along a direction from an outer peripheral edge of the positioning portion 221 toward a bottom of the top plate 212, and a second bonding portion 223 extending along a direction from a bottom end of the first bonding portion 222 toward an outer peripheral edge of the top plate 212. When the annular positioning member 22 is connected to the annular connecting member 21, an outer peripheral side surface of the first bonding portion 222 is bonded to an inner peripheral side surface of the top plate 202, a top surface of the second bonding portion 223 is bonded to a top wall of the bonding groove 2121, an outer peripheral side surface of the second bonding portion 223 is bonded to an outer peripheral side wall of the bonding groove 2121, and a top surface of the positioning portion 221 is flush with a top surface of the top plate 212. The annular connecting member 21 is made of a rigid material, such as hard rubber, plastic or metal. In this example, the first bonding portion 222 and the second bonding portion 223 are arranged at the bottom side of the top plate 212, so that when the positioning portion 221 is subjected to an acting force exerted by the beverage container 200 in a direction away from the bottom end of the placement cavity 14, the annular positioning member 22 can exert an acting force on the beverage container 200 toward the bottom end of the placement cavity 14 by using the counterforce exerted by the top plate 212 on the first bonding portion 222 and the second bonding portion 223 toward the bottom end of the placement cavity 14. In this way, the beverage container 200 is supported and limited by the annular positioning member 22 and the annular connecting member 21 as a whole, so that the beverage container 200 can be clamped between the positioning structure 20 and the adjusting structure 30 more stably.

In some specific examples, the positioning portion 221 and the top plate 212 partially cover the through hole 1231, and a middle of the positioning portion 221 forms an opening 2210 communicated with the through hole 1231. The positioning portion 221 includes a positioning ring 2211 connected with the first bonding portion 222 and four positioning pieces 2212 connected with the positioning ring 2211. The positioning piece 2212 is arranged annularly along a circumferential direction of the positioning ring 2211, and there is an adjusting gap 2213 communicated with the opening 2210 between every two adjacent positioning pieces 2211. When an external driving force from the beverage container 200 acts on any of the positioning pieces 2212, the positioning piece 2212 moves along a radial direction of the sleeve 10 to form a variable region, so that the adaptive beverage container sleeve kit can be adapted to the beverage container 200 with different widths.

In some specific examples, the outer shell 11 or the inner shell 12 is made of a rigid material, such as hard rubber, plastic or metal. Optionally, the outer shell 11 and the inner shell 12 are both made of stainless steel to provide a good thermal insulation effect.

Figure 10:
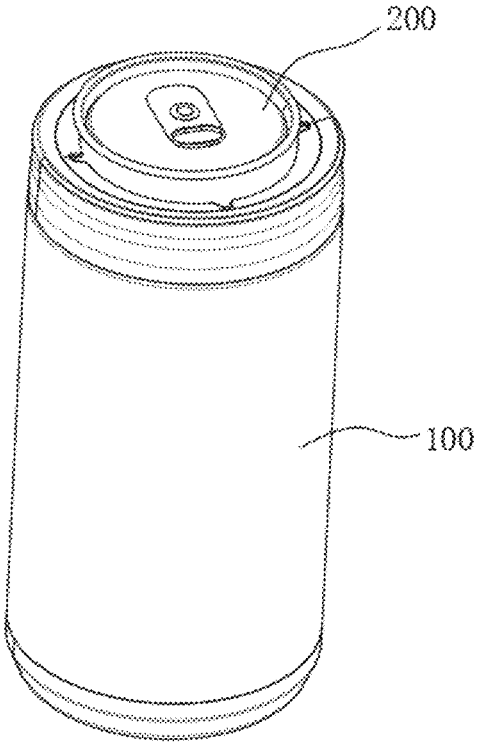
FIG. 10 is a schematic structural view I of the beverage container sleeve kit and a beverage container according to an example of the disclosure.
Figure 11:
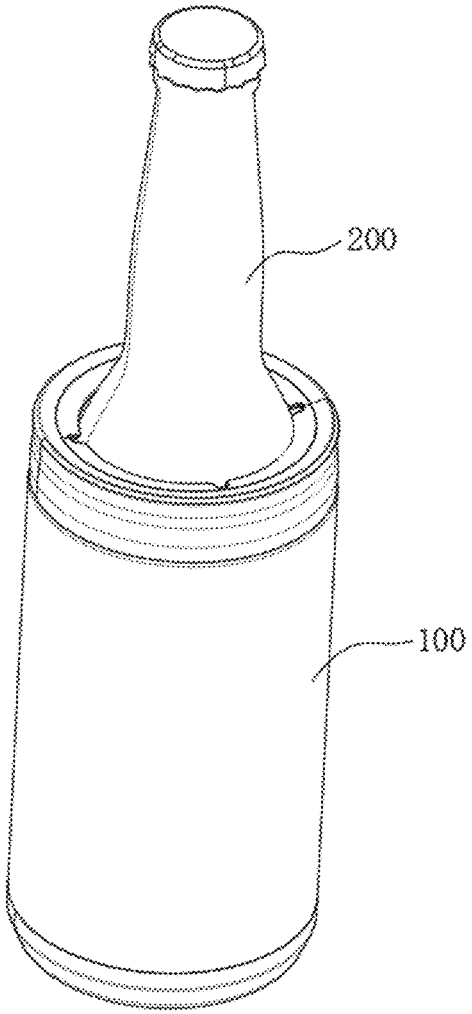
FIG. 11 is a schematic structural view II of the beverage container sleeve kit and the beverage container according to an example of the disclosure.
Figure 12:
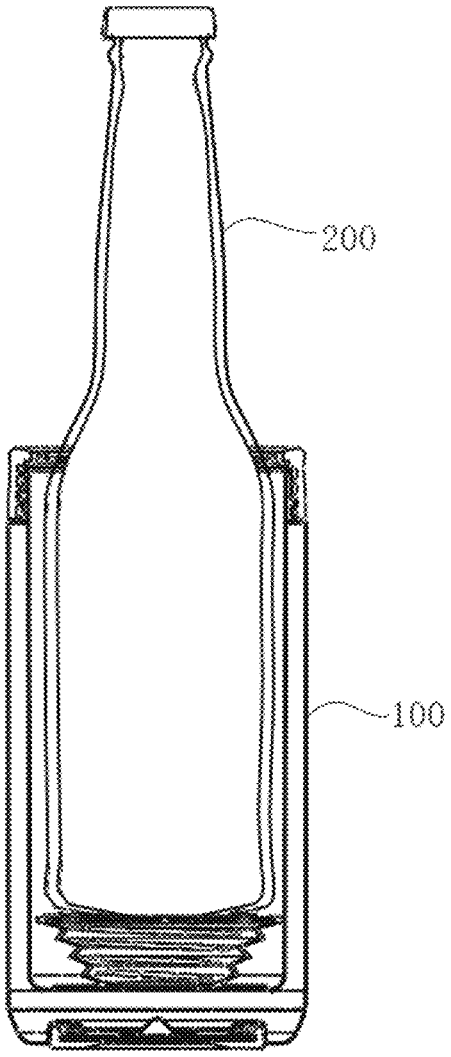
FIG. 12 is a schematic structural sectional view of the beverage container sleeve kit and the beverage container according to an example of the disclosure.

As shown in FIG. 10 to FIG. 12, in some specific examples, the beverage container 200 may be a bottle or a can. After the beverage container 200 is put into the placement cavity 14 via the through hole 1231, all or part of the beverage container 200 is clamped between the positioning structure 20 and the adjusting structure 30 by means of the connection between the positioning structure 20 and the sleeve 10. In other examples, the beverage container 200 may also be a cup or other beverage containers for containing beverages such as wine, water, juice and coffee. The beverage container 200 may also be directly put into the placement cavity 14 via the variable region until all or part of the beverage container 200 is clamped between the positioning structure 20 and the adjusting structure 30. In this case, the included angle A between the top plate 212 and the side plate 211 in a sectional view is less than 90°, the annular positioning member 22 is arranged along the direction from the top plate 212 toward the inside of the placement cavity 14, and the top surface of the positioning portion 221 is flush with the top surface of the top plate 212. Therefore, the top surface of the positioning portion 221 and the top surface of the top plate 212 jointly form an inclined guide surface for guiding the beverage container 200 into the placement cavity 14, so that the beverage container 200 can be put into the placement cavity 14 conveniently.

Finally, it should be noted that the above embodiments are only used to illustrate the technical solution of the present invention, and not to limit it; Although the present invention has been described in detail with reference to the aforementioned embodiments, those skilled in the art should understand that they can still modify the technical solutions described in the aforementioned embodiments, or equivalently replace some of the technical features; And these modifications or substitutions do not deviate from the essence of the corresponding technical solutions from the scope of the various embodiments of the present invention.

In summary, the above description is only a preferred embodiment of the present invention, and any equivalent changes and modifications made within the scope of the present invention patent application should be within the scope of the present invention patent.

What is claimed is:

1. An adaptive beverage container sleeve kit, comprising:

a sleeve for sleeving a beverage container, comprising an outer shell, an inner shell and a sealed vacuum cavity, wherein the inner shell has a first inner wall and a first outer wall, the first inner wall of the inner shell forming a placement cavity for accommodating the beverage container, and the sealed vacuum cavity being located between the outer shell and the inner shell such that the sleeve functions to maintain a temperature; the inner shell has a top and a bottom end, the top being provided with a through hole through which the beverage container is put in or taken out;

a positioning structure, detachably connected to a top of the sleeve and configured to bond the beverage container with different widths, wherein the positioning structure is capable of contacting at least a part of the beverage container such that when the beverage container sleeve kit is inverted, the beverage container does not fall out of the beverage container sleeve kit; besides, when the positioning structure is connected to the sleeve and contacts the beverage container, the user is capable of drinking a beverage from the beverage container; and an adjusting structure, located in the placement cavity, wherein the adjusting structure is arranged along the bottom end of the inner shell and has a bonding portion connected with the bottom end of the inner shell and a contact portion contacting a bottom end of the beverage container, a height between the bonding portion and the contact portion is deformable to adapt to placement of the beverage container with different heights, and the adjusting structure is deformed to adjust a height along a direction from a bottom end toward a top of the placement cavity, a height of the deformation being less than an overall height of the inner shell, and a width of the deformation being less than a width of the inner shell;

wherein the adjusting structure comprises an elastic member arranged along the direction from the bottom end toward the top of the placement cavity, the elastic member, when subjected to a pressure exerted by the beverage container toward the bottom end of the placement cavity, being capable of providing an elastic force for pushing the beverage container to move toward the top of the placement cavity such that at least a part of the beverage container keeps in contact with the positioning structure;

wherein the adjusting structure further comprises a cylindrical member arranged along the direction from the bottom end toward the top of the placement cavity, wherein the bonding portion is connected to a bottom end of the cylindrical member, and the contact portion is connected to a top end of the cylindrical member; an elastic cavity for accommodating the elastic member is arranged inside the cylindrical member; the cylindrical member is deformable in height; and when the beverage container is placed in the placement cavity, the cylindrical member and the elastic member are deformed and shortened in height under the pressure of the beverage container, and under the action of the elastic force of the elastic member, the height of the cylindrical member is kept at a position capable of clamping all or part of the beverage container between the positioning structure and the contact portion;

wherein the cylindrical member is deformable synchronously with the elastic member;

wherein the cylindrical member is provided as a deformable corrugated tube structure made of a rigid material, or the cylindrical member is made of a flexible deformable material.

2. The beverage container sleeve kit according to claim 1, wherein the cylindrical member comprises a plurality of first conical ring pieces and second conical ring pieces arranged alternately, wherein the first conical ring pieces are each arranged at an acute angle relative to a bottom surface of the inner shell, and the second conical ring pieces are each arranged at an obtuse angle relative to the bottom surface of the inner shell; the second conical ring piece has a bottom end connected to a top end of one first conical ring piece and a top end connected to a bottom end of another first conical ring piece; and when the cylindrical member is deformed and shortened, an inner surface of the second conical ring piece and an inner surface of the one first conical ring piece become close to each other, and an outer surface of the second conical ring piece and an outer surface of the another first conical ring piece become close to each other.

3. The beverage container sleeve kit according to claim 2, wherein the positioning structure comprises an annular connecting member to be detachably connected to the top of the sleeve and an annular positioning member connected along an inner peripheral edge of a top of the annular connecting member, the annular positioning member being made of a flexible material, and when a width of the beverage container in the placement cavity is greater than a width of an inner periphery of the annular positioning member, a force acting on the beverage container drives the annular positioning member to be deformed to a width required for the placement of the beverage container, and all or part of the beverage container is clamped between the annular positioning member and the contact portion by means of a combination of the annular positioning member and the beverage container;

wherein the annular connecting member comprises a side plate arranged along a height direction and a top plate formed by extending from an inner peripheral edge of a top of the side plate toward an inside of the placement cavity, an inner wall of the side plate being provided with a first threaded structure; the outer shell has a second inner wall and a second outer wall, a top of the second outer wall being provided with a second threaded structure; and the positioning structure and the sleeve are detachably connected by means of a threaded fit between the first threaded structure and the second threaded structure;

wherein an included angle between the top plate and the side plate in a sectional view is less than 90°, and a bottom surface of the top plate is depressed along an inner peripheral edge of the top plate to form a bonding groove; the annular positioning member is arranged along a direction from the top plate toward the inside of the placement cavity, and comprises a positioning portion for contacting the beverage container, a first bonding portion extending along a direction from an outer peripheral edge of the positioning portion toward a bottom of the top plate, and a second bonding portion extending along a direction from a bottom end of the first bonding portion toward an outer peripheral edge of the top plate; and when the annular positioning member is connected to the annular connecting member, an outer peripheral side surface of the first bonding portion is bonded to an inner peripheral side surface of the top plate, a top surface of the second bonding portion is bonded to a top wall of the bonding groove, an outer peripheral side surface of the second bonding portion is bonded to an outer peripheral side wall of the bonding groove, and a top surface of the positioning portion is flush with a top surface of the top plate; and wherein the positioning portion and the top plate partially cover the through hole, and a middle of the positioning portion forms an opening communicated with the through hole; the positioning portion comprises a positioning ring connected with the first bonding portion and at least two positioning pieces connected with the positioning ring, the positioning piece being arranged annularly along a circumferential direction of the positioning ring, and there being an adjusting gap communicated with the opening between every two adjacent positioning pieces; and when an external driving force acts on any of the positioning pieces, the positioning piece moves along a radial direction of the sleeve to form a variable region.

4. The beverage container sleeve kit according to claim 1, wherein the bonding portion comprises a first annular piece formed by extending outward from a bottom end of the elastic member along a circumferential direction and a first limiting piece formed by extending inward from the bottom end of the elastic member along the circumferential direction, the bottom end of the elastic member being capable of being limited at a top surface of the first limiting piece.

5. The beverage container sleeve kit according to claim 4, wherein the contact portion comprises a second annular piece formed by extending inward from a top end of the elastic member along a circumferential direction and a second limiting piece detachably connected in the second annular piece, a middle of the second annular piece forming a mounting hole through which the elastic member is put in or taken out, and the top end of the elastic member being capable of being limited at a bottom surface of the second limiting piece and/or the second annular piece.

6. The beverage container sleeve kit according to claim 5, wherein the second limiting piece comprises a main body portion and a boss portion formed by protruding outward from a middle of a top of the main body portion, and when the second limiting piece is connected to the second annular piece, a top surface on an outer periphery of the main body portion is limited at the bottom surface of the second annular piece, the boss portion is limited in the mounting hole, and the bottom end of the beverage container is capable of contacting a top surface of the second annular piece and/or a top surface of the boss portion.

7. The beverage container sleeve kit according to claim 6, wherein the positioning structure comprises an annular connecting member to be detachably connected to the top of the sleeve and an annular positioning member connected along an inner peripheral edge of a top of the annular connecting member, the annular positioning member being made of a flexible material, and when a width of the beverage container in the placement cavity is greater than a width of an inner periphery of the annular positioning member, a force acting on the beverage container drives the annular positioning member to be deformed to a width required for the placement of the beverage container, and all or part of the beverage container is clamped between the annular positioning member and the contact portion by means of a combination of the annular positioning member and the beverage container;

wherein the annular connecting member comprises a side plate arranged along a height direction and a top plate formed by extending from an inner peripheral edge of a top of the side plate toward an inside of the placement cavity, an inner wall of the side plate being provided with a first threaded structure; the outer shell has a second inner wall and a second outer wall, a top of the second outer wall being provided with a second threaded structure; and the positioning structure and the sleeve are detachably connected by means of a threaded fit between the first threaded structure and the second threaded structure;

wherein an included angle between the top plate and the side plate in a sectional view is less than 90°, and a bottom surface of the top plate is depressed along an inner peripheral edge of the top plate to form a bonding groove; the annular positioning member is arranged along a direction from the top plate toward the inside of the placement cavity, and comprises a positioning portion for contacting the beverage container, a first bonding portion extending along a direction from an outer peripheral edge of the positioning portion toward a bottom of the top plate, and a second bonding portion extending along a direction from a bottom end of the first bonding portion toward an outer peripheral edge of the top plate; and when the annular positioning member is connected to the annular connecting member, an outer peripheral side surface of the first bonding portion is bonded to an inner peripheral side surface of the top plate, a top surface of the second bonding portion is bonded to a top wall of the bonding groove, an outer peripheral side surface of the second bonding portion is bonded to an outer peripheral side wall of the bonding groove, and a top surface of the positioning portion is flush with a top surface of the top plate; and wherein the positioning portion and the top plate partially cover the through hole, and a middle of the positioning portion forms an opening communicated with the through hole; the positioning portion comprises a positioning ring connected with the first bonding portion and at least two positioning pieces connected with the positioning ring, the positioning piece being arranged annularly along a circumferential direction of the positioning ring, and there being an adjusting gap communicated with the opening between every two adjacent positioning pieces; and when an external driving force acts on any of the positioning pieces, the positioning piece moves along a radial direction of the sleeve to form a variable region.

8. The beverage container sleeve kit according to claim 4, wherein the positioning structure comprises an annular connecting member to be detachably connected to the top of the sleeve and an annular positioning member connected along an inner peripheral edge of a top of the annular connecting member, the annular positioning member being made of a flexible material, and when a width of the beverage container in the placement cavity is greater than a width of an inner periphery of the annular positioning member, a force acting on the beverage container drives the annular positioning member to be deformed to a width required for the placement of the beverage container, and all or part of the beverage container is clamped between the annular positioning member and the contact portion by means of a combination of the annular positioning member and the beverage container.

9. The beverage container sleeve kit according to claim 1, wherein the cylindrical member is provided with at least one airflow holes communicating the elastic cavity with the placement cavity.

10. The beverage container sleeve kit according to claim 9, wherein the positioning structure comprises an annular connecting member to be detachably connected to the top of the sleeve and an annular positioning member connected along an inner peripheral edge of a top of the annular connecting member, the annular positioning member being made of a flexible material, and when a width of the beverage container in the placement cavity is greater than a width of an inner periphery of the annular positioning member, a force acting on the beverage container drives the annular positioning member to be deformed to a width required for the placement of the beverage container, and all or part of the beverage container is clamped between the annular positioning member and the contact portion by means of a combination of the annular positioning member and the beverage container.

11. The beverage container sleeve kit according to claim 1, wherein the first limiting piece and the second limiting piece are provided as annular structures.

12. The beverage container sleeve kit according to claim 1, wherein the positioning structure comprises an annular connecting member to be detachably connected to the top of the sleeve and an annular positioning member connected along an inner peripheral edge of a top of the annular connecting member, the annular positioning member being made of a flexible material, and when a width of the beverage container in the placement cavity is greater than a width of an inner periphery of the annular positioning member, a force acting on the beverage container drives the annular positioning member to be deformed to a width required for the placement of the beverage container, and all or part of the beverage container is clamped between the annular positioning member and the contact portion by means of a combination of the annular positioning member and the beverage container;

wherein the annular connecting member comprises a side plate arranged along a height direction and a top plate formed by extending from an inner peripheral edge of a top of the side plate toward an inside of the placement cavity, an inner wall of the side plate being provided with a first threaded structure; the outer shell has a second inner wall and a second outer wall, a top of the second outer wall being provided with a second threaded structure; and the positioning structure and the sleeve are detachably connected by means of a threaded fit between the first threaded structure and the second threaded structure;

wherein an included angle between the top plate and the side plate in a sectional view is less than 90°, and a bottom surface of the top plate is depressed along an inner peripheral edge of the top plate to form a bonding groove; the annular positioning member is arranged along a direction from the top plate toward the inside of the placement cavity, and comprises a positioning portion for contacting the beverage container, a first bonding portion extending along a direction from an outer peripheral edge of the positioning portion toward a bottom of the top plate, and a second bonding portion extending along a direction from a bottom end of the first bonding portion toward an outer peripheral edge of the top plate; and when the annular positioning member is connected to the annular connecting member, an outer peripheral side surface of the first bonding portion is bonded to an inner peripheral side surface of the top plate, a top surface of the second bonding portion is bonded to a top wall of the bonding groove, an outer peripheral side surface of the second bonding portion is bonded to an outer peripheral side wall of the bonding groove, and a top surface of the positioning portion is flush with a top surface of the top plate.

13. The beverage container sleeve kit according to claim 12, wherein the positioning portion and the top plate partially cover the through hole, and a middle of the positioning portion forms an opening communicated with the through hole; the positioning portion comprises a positioning ring connected with the first bonding portion and at least two positioning pieces connected with the positioning ring, the positioning piece being arranged annularly along a circumferential direction of the positioning ring, and there being an adjusting gap communicated with the opening between every two adjacent positioning pieces; and when an external driving force acts on any of the positioning pieces, the positioning piece moves along a radial direction of the sleeve to form a variable region.

14. The beverage container sleeve kit according to claim 1, wherein the positioning structure comprises an annular connecting member to be detachably connected to the top of the sleeve and an annular positioning member connected along an inner peripheral edge of a top of the annular connecting member, the annular positioning member being made of a flexible material, and when a width of the beverage container in the placement cavity is greater than a width of an inner periphery of the annular positioning member, a force acting on the beverage container drives the annular positioning member to be deformed to a width required for the placement of the beverage container, and all or part of the beverage container is clamped between the annular positioning member and the contact portion by means of a combination of the annular positioning member and the beverage container.

* * * * *